United States Patent [19]

Contento

[11] 3,963,243

[45] June 15, 1976

[54] HORSE RACING BOARD GAME APPARATUS

[76] Inventor: Jerry Contento, 622 W. New York Ave., Somers Point, N.J. 08244

[22] Filed: Sept. 3, 1975

[21] Appl. No.: 609,926

[52] U.S. Cl. ..... 273/134 CH; 273/134 AG; 273/134 G; 273/130 H; 273/146; 46/22; 46/127

[51] Int. Cl.[2] ..... A63F 3/00

[58] Field of Search ..... 273/130, 134

[56] References Cited

UNITED STATES PATENTS

| | | | |
|---|---|---|---|
| 1,697,023 | 1/1929 | Rottenburg | 273/134 DB |
| 1,797,742 | 3/1931 | Ward | 273/134 AG |
| 3,298,692 | 1/1967 | Glass et al. | 273/134 B |
| 3,738,659 | 6/1973 | Partridge | 273/134 AG |

FOREIGN PATENTS OR APPLICATIONS

| | | | |
|---|---|---|---|
| 749,939 | 5/1933 | France | 273/134 CH |
| 1,322,799 | 2/1963 | France | 273/134 CH |
| 611,043 | 10/1948 | United Kingdom | 273/134 B |

*Primary Examiner*—Delbert B. Lowe
*Attorney, Agent, or Firm*—B. P. Fishburne, Jr.

[57] ABSTRACT

An indoor or table-type horse racing game employs a game board having a race track extending around the perimeter thereof and said race track having lanes for plural simulated race horse game pieces having separable saddles, bridles and jockeys which are lost to the players in certain penalty situations but can be regained in player award situations under the rules of the game. Dice are employed by the players for advancing the game pieces set numbers of spaces along said lanes.

9 Claims, 5 Drawing Figures

FIG. 2
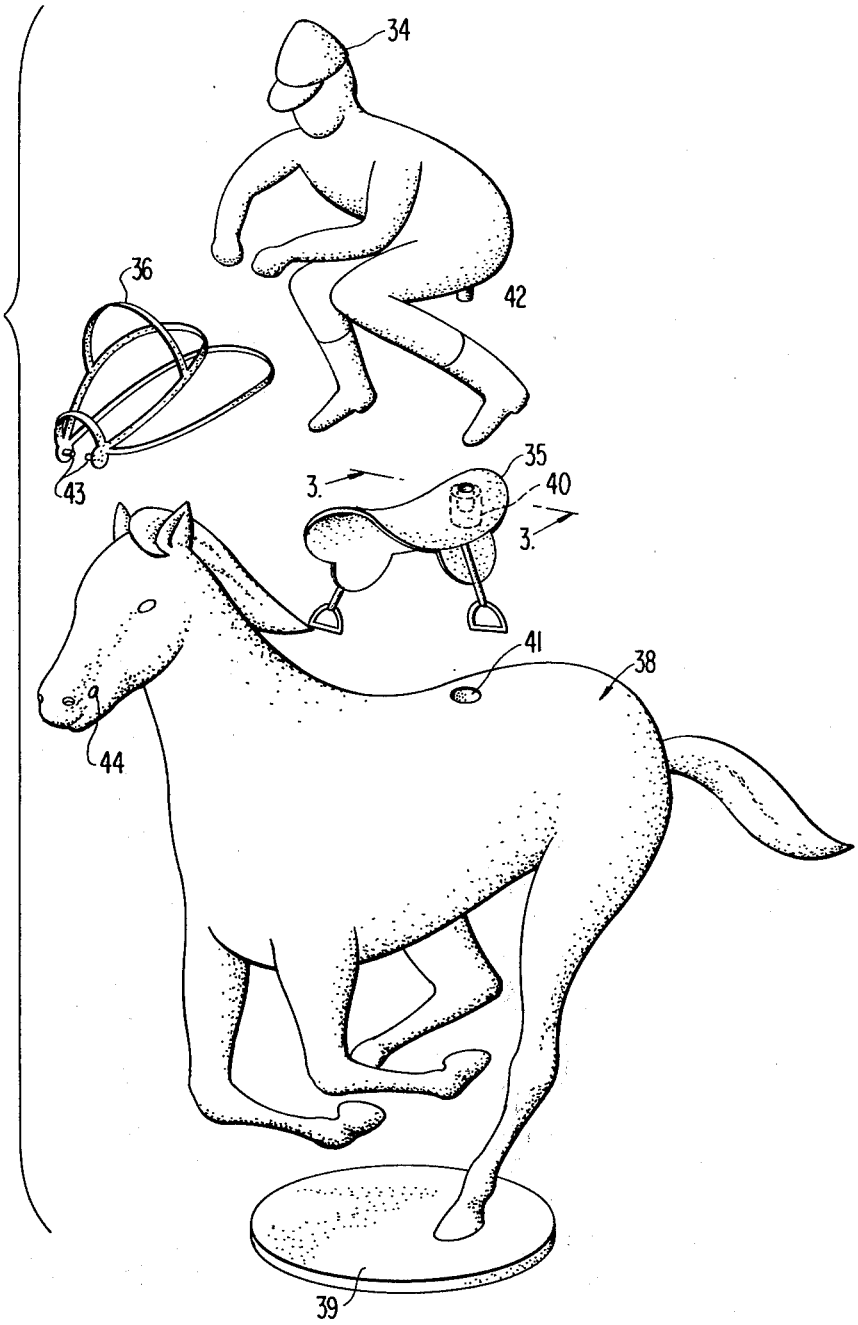
FIG. 3
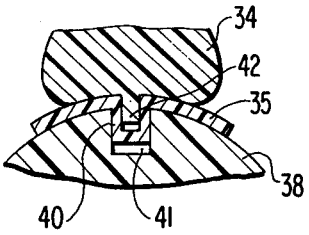
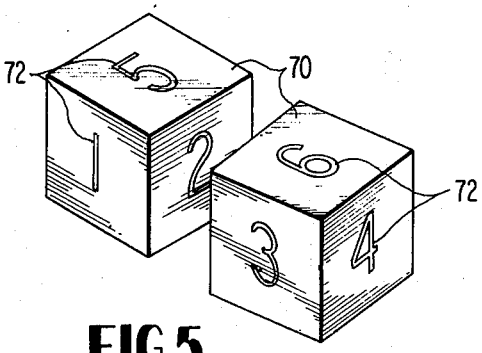
FIG. 5
FIG. 4
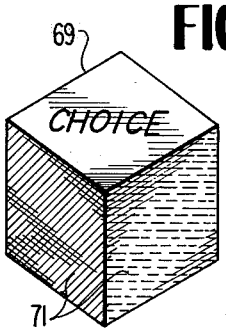

HORSE RACING BOARD GAME APPARATUS

BACKGROUND OF THE INVENTION

A need constantly exists for more fascinating and realistic table games of economical construction to attract the interest of young and old. It is the principal object of this invention to assist in fulfilling this need by the provision of an extremely interesting and fast moving horse racing game which can be played by plural players on a competitive basis and which employs many of the features of realism found in professional racing.

Another object is to avoid some of the pitfalls of the prior art by providing a racing game whose playing rules are simplified and not confusing and in avoiding the possiblity of boredom sometimes prevalent in table games due to repetition in playing, without variation.

Other features and advantages of the invention will become apparent during the course of the following description.

BRIEF DESCRIPTION OF DRAWING FIGURES

FIG. 2 is an exploded perspective view of a game piece as employed by each player of the game.

FIG. 3 is an enlarged fragmentary vertical section taken on line 3—3 of FIG. 2.

FIG. 4 is a perspective view of a color coded horse selection die employed in the playing of the game.

FIG. 5 is a perspective view of a pair of numeric dice also employed by the players according to the rules of the game.

DETAILED DESCRIPTION

Figure 1:
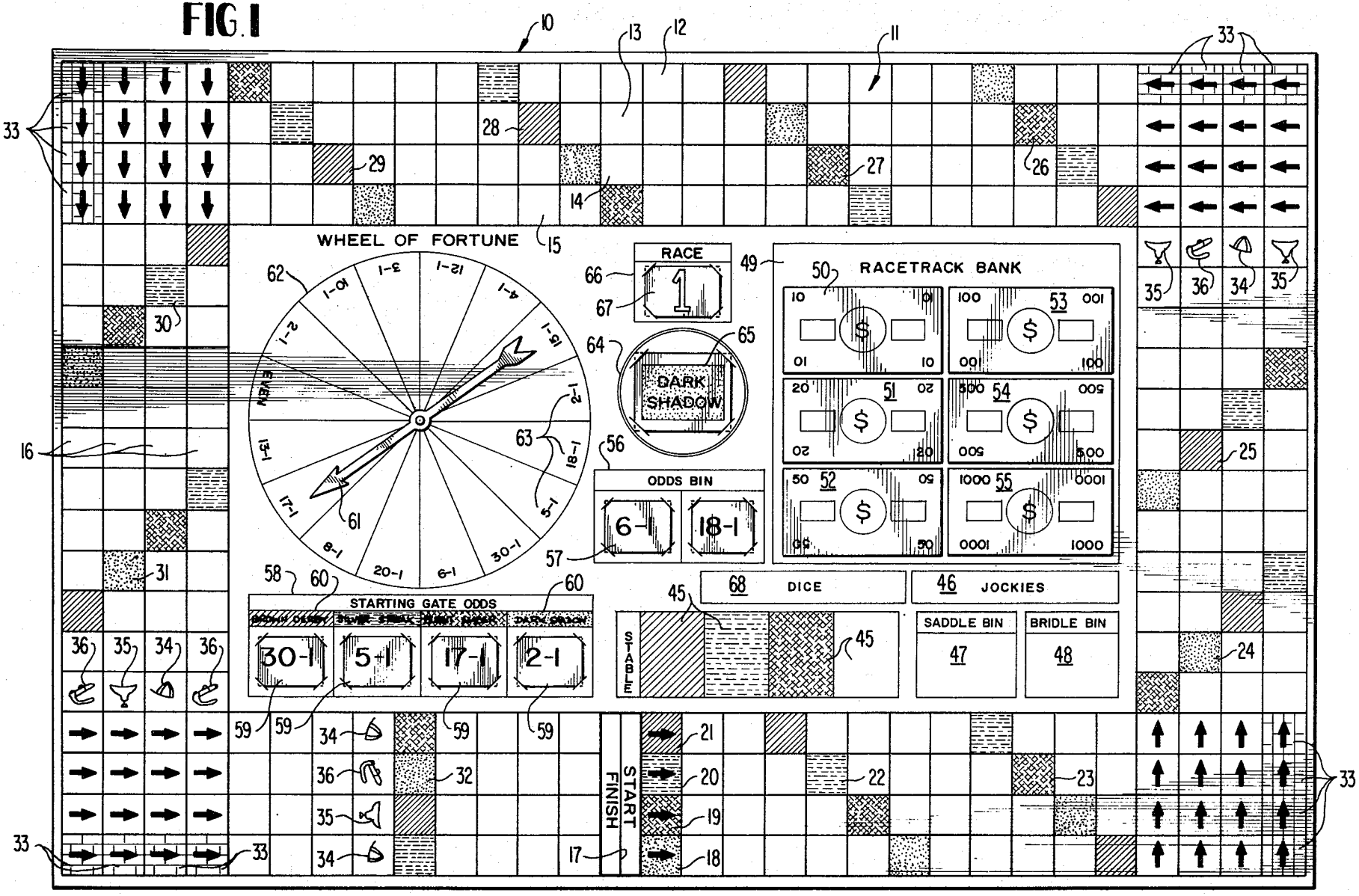
FIG. 1 is a plan view of a game board embodying the invention.

Referring to the drawings in detail wherein like numerals designate like parts, and referring first to FIG. 1, the game comprises a rectangular game or playing board 10 which in a practical embodiment of the game may measure approximately 20 inches by 30 inches, although these dimensions are not critical and may be varied somewhat. The game board may be formed of any conventional material, such as wood, plastic, or pressed paper, and its thickness and other physical characteristics are unimportant to the present invention.

The marginal or perimeter portion of the board 10 is suitably imprinted to provide a racing track 11, which in the embodiment shown is divided by parallel lines into preferably four racing lanes 12, 13, 14 and 15 from outside to inside positions, as shown. These lanes 12 through 15 correspond to the number of race horses in the race, the number of jockeys and the number of players of the game, as will be fully described.

The several racing lanes 12 through 15 are each divided throughout their entire lengths on the game board into equal numbers of squares or playing spaces 16, such as 1 inch squares in a practical embodiment of the game. At a convenient point on one of the long sides of the rectangular board 10, a race "start" and "finish" line 17 is delineated. Immediately ahead of this start and finish line in the first laterally adjacent group of squares, such squares are color coded to match the race horse colors yet to be described. For example, these squares may be colored black, rust, silver and brown from the outside lane to the innermost lane, as indicated by the numerals 18, 19, 20 and 21. At regular intervals along the race track, these distinctly colored squares are repeated in multiple diagonal rows 22, 23, 24, 25, 26, 27, 28, 29, 30 and 31 with the colors in the different lanes mixed or scrambled across the diagonal rows 22 through 31 to avoid stereotyped repetition. Somewhat before the finish line 17 or in the "home stretch" part of the track, another laterally adjacent row of colored squares 32 is provided on the board, again in mixed or scrambled relationship to the first row of colored squares 18 through 21.

At each corner of the board and race track, a group of four adjacent squares 33 are designed or imprinted to simulate dead end brick walls which must be avoided by the horses. Near one pair of diagonally opposite corners of the track and immediately ahead of the colored squares 32, printed symbols 34, 35, 36 are provided on laterally adjacent squares of the four lanes, indicative of jockeys, saddles and bridles used with the horse simulating player or game pieces 38. The elements 34, 35 and 36 for each horse-like game piece 38 are colored to correspond with the color of the game pieces 38 used by a particular player of the game.

With particular reference to FIGS. 2 and 3, each game piece 38 includes a body portion shaped to simulate a race horse and having an attached support base 39 of a size to fit into one of the squares 16 of the race track. Each saddle simulating element 35 is curved to fit onto the top of the game piece 38 and has an integral depending hollow sleeve extension 40, received frictionally and separably in a socket opening 41 in the top of the game piece 38. Likewise, the jockey simulating element 34 is shaped to rest on the saddle 35 and is equipped with a dependent dowel pin 42 received frictionally and separably in the interior of the saddle sleeve extension 40. Hence, the three parts 38, 35 and 34 are telescoped frictionally in assembly and are adapted to be readily separated and reassembled during the playing of the game, according to rules yet to be explained. Similarly, the bridle element 36 of each game piece assembly is detachably secured to the head portion of game piece 38 by small pins 43 which may snap into small openings 44 on the opposite side of the horse-like head portion of game piece 38. All of the components described in FIGS. 2 and 3 are very well adapted to be formed of plastics.

For the convenience of players to further enhance realism, the four distinctly colored horse simulating game pieces 38 while not racing are placed on the board on correspondingly colored rectangles 45 visibly designated "stable". Similarly, the jockey simulating elements 34 are stored in a bin area 46 designated 37 jockeys" and similar bin areas 47 and 48 on the game board constitute assembly areas for the saddle and bridle elements 35 and 36. If desired, these storage areas 45, 46, 47 and 48 may be constituted in small cup-like three-dimensional bins formed on or attached to the game board. In other cases, the storage areas may be simply printed indicia areas on the game board, as shown. In a like manner, other game playing elements are provided and are placed in an orderly manner in prescribed areas of the board 10 inside of the marginal race track area. These include a "race track bank" 49 large enough to hold a stack 50 of 25 simulated 10 dollar bills, another stack 51 of 25 simulated 20 dollar bills, a stack 52 of 20 simulated 50 dollar bills, a stack 53 of 20 simulated 100 dollar bills, a stack 54 of 25 simulated 500 dollar bills, and a stack 55 of 20 simulated 1000 dollar bills. An "odds bin" 56 is provided for racing odds tickets 57, numbering four each, of odds designations "1—1" through "30–1". A "starting gate odds" area 58 has provision for holding the four starting gate odds tickets 59 for a particular race, corresponding to the name and color designations of the four race horses, imprinted at 60 in the area 58.

Further, in connection with the determination of odds for each race and each player, a "wheel of fortune" spinning pointer 61 is also provided in registry with a circular indicia area 62 on the game board having imprinted thereon the various odds indicia 63 to coact with the pointer 61. A "winner's circle" 64 is also indicated on the face of the game board adapted to receive a colored horse name card 65 indicative of the winner of a particular race. Four such name cards 65 bearing four distinct horses' names and colors may be stored within the circle area 64. A "race number" area 66 is provided on the board for the storage of 10 race number cards 67, numbered 1 through 10, to add further realism to the game. Finally, a storage area 68 for the dice 69, FIG. 4, and 70, FIG. 5, is provided on the board 10. The single die 69 is color coded on four of its sides as at 71 to correspond with the color coding of the race horses and separable components and the other two faces of the die 69 are marked "choice" or "your choice". A pair of dice 70 employed to determine the number of squares over which the game pieces 38 are advanced are numbered on their faces with the numerals 1 through 6 as shown at 72 in the drawings.

Playing the Game

Normally, four players participate in the game in a preferred embodiment of the invention. One separable game piece embodying components 38, 35, 34 and 36 is used by each player. The objective of the game is to win the race with a fully equipped and mounted horse. Usually, there will be ten races in a complete game although this feature can be varied as desired. The four horses have designated names on the cards 65 and in the starting gate area 58, such as "Brown Derby", "Silver Streak", "Burnt Amber" and "Dark Shadow", with the names keyed to the color coding of the game board and game pieces. At the start of the game, each player in turn rolls the "horse choice" die 69 once to determine his or her horse color or game piece color. If the particular player rolls choice on the die 69, he or she can choose any desired horse. Otherwise, the player must utilize the horse color indicated on the top face of die 69 after the roll of the die.

Next, each player in turn spins the wheel of fortune to determine his odds for each race usually beginning with the player having the Brown Derby entry. The odds are posted at the starting gate 58 and the game is ready to begin.

Prior to the first roll of the dice 70, each player is paid $100 (10 races times 10 dollars bet on each race) out of the race track bank 49. Each player bets a minimum of $2.00 for each race run. All bets are made to the bank. Each winning player wins $10 times his odds. For example, if Brown Derby goes off at 30–1 and wins the race, he is paid $300 from the bank.

The players in turn place their fully assembled horse game pieces 38 with accessories 35, 34 and 36 on the corresponding colored square 18–21 at the starting gate. The dice 70 are rolled once by each player and the numbers on the tops of the dice after rolling indicate the total number of squares 16 in a particular player lane which the player advances his game piece, 11 squares according to the example shown in FIG. 5.

If a player lands on one of the randomly colored squares 22 through 32 on the board corresponding to the color of his horse or game piece 38, he is allowed a second roll of the dice and a second advancement of his piece accordingly. If the player lands on another player's color, he remains in that position on the board and the player whose color square he landed on advances his horse the same number of squares designated by the thrower of the dice 70. If the player rolling the dice lands on his own color on the board, he also receives back any of the accessories 34, 35 or 36 which he may have lost on previous plays.

If any player lands in a brick wall square 33 on any roll of the dice 70, he loses his next turn or roll.

If any player on rolling the dice 70 has his game piece land on any of the accessory symbols 34, 35 or 36 on the board, such player loses that item from his mount. He can regain the accessories lost by landing on his own color square 22, 23, 24, etc. on his next roll of the dice or any subsequent roll, as mentioned.

The winner of the previous race is posted in the winner's circle 64 during the running of the next race or current race. As previously mentioned, the winner of each race is the player whose horse reaches the finish line 17 first with all accessory elements 35, 34 and 36 properly mounted.

Variations can be made in the rules of play without departing from the scope or substance of the invention.

It is to be understood that the form of the invention herewith shown and described is to be taken as a preferred example of the same, and that variations in the shape, size and arrangement of parts may be resorted to, without departing from the spirit of the invention or scope of the subjoined claims.

I claim:

1. A horse racing game comprising a game board having a marginal race track area thereon, said race track area divided into plural racing lanes for a corresponding number of race horse game pieces, said racing lanes each divided into a multiplicity of substantially equal size spaces, certain spaces of each lane having penalty indicia thereon and certain spaces having award indicia thereon, each race horse game piece comprising a race horse simulating body portion and accessory elements mounted detachably on said body portion, whereby movement of race horse game pieces onto said penalty and award indicia of the racing lanes during playing of the game may result in the loss or regaining of said accessory elements by players.

2. A horse racing game as defined by claim 1, and said accessory elements consisting of a saddle, a jockey and a bridle separably attached to said body portion.

3. A horse racing game as defined by claim 2, and wherein said body portion has a socket recess, said saddle having a dependent sleeve engageable separably in the socket recess, and said jockey having a dependent pin element engageable separably in said sleeve of the saddle, said bridle having pin attachment elements and said body portion having additional sockets receiving the pin attachment elements separably.

4. A horse racing game as defined by claim 1, and at least some of said racing lane indicia being colored indicia, and each race horse game piece corresponding in color with one racing lane colored indicia.

5. A horse racing game as defined by claim 2, wherein at least some of said racing lane indicia correspond pictorially to said saddle, jockey and bridle accessory elements.

6. A horse racing game as defined by Claim 1, and chance controlled claim operated by the players of the game to indicate the advancement of said game pieces along said racing lanes.

7. A horse racing game as defined by claim 6, and said chance controlled means comprising numeric dice.

8. A horse racing game as defined by claim 1, and said game board being rectangular and having a center rectangular area surrounded by said race track area and forming a storage space for game accessories.

9. A horse racing game as defined by claim 8, and including race track money, chance controlled means operated by players to establish racing odds, a winner's circle means and storage spaces for said race horse game pieces and their accessories.

* * * * *